US005346076A

United States Patent [19]

Hart

[11] Patent Number: 5,346,076

[45] Date of Patent: Sep. 13, 1994

[54] ELONGATED ELEMENT DISPLAY AND RETENTION APPARATUS

[75] Inventor: Douglas M. Hart, Sacramento, Calif.

[73] Assignee: OrePac Building Products, Wilsonville, Oreg.

[21] Appl. No.: 31,843

[22] Filed: Mar. 16, 1993

[51] Int. Cl.[5] ..... A47F 5/00

[52] U.S. Cl. ..... 211/86; 40/642; 211/49.1

[58] Field of Search ..... 211/59.4, 60.1, 49.1, 211/86; 40/642, 651, 621, 661

[56] References Cited

U.S. PATENT DOCUMENTS 3,227,503 1/1966 Fletcher et al. ..... 211/60.1 X
3,385,451 5/1968 Anderson ..... 211/60.1
4,557,064 12/1985 Thompson ..... 40/642
4,698,928 10/1987 Soporowski ..... 40/651
4,866,868 9/1989 Kass ..... 40/661
5,044,104 9/1991 Hopperdietzel ..... 40/642
5,111,943 5/1992 Ramey ..... 211/59.4
5,255,802 10/1993 Krinke et al. ..... 211/60.1 X
5,272,826 12/1993 Gingras ..... 40/642

*Primary Examiner*—Robert W. Gibson, Jr.
*Attorney, Agent, or Firm*—Thomas R. Lampe

[57] ABSTRACT

Apparatus is attached to a storage rack for moldings and similar elongated elements to provide information concerning the elongated elements and assist in maintaining the elongated elements in a generally upright condition on the storage rack. The apparatus includes a housing having an inclined back wall for displaying informational materials and a removable transparent front wall allowing an observer to view the informational materials.

9 Claims, 3 Drawing Sheets

ELONGATED ELEMENT DISPLAY AND RETENTION APPARATUS

TECHNICAL FIELD

This invention relates to apparatus for displaying elongated elements and retaining the elongated elements in a rack. The invention has particular application to the display and retention of elongated mouldings at facilities where the elongated mouldings are being sold.

BACKGROUND ART

It is well known to display elongated wood mouldings and similar elongated elements in a generally upright condition on display racks when the elongated elements are being sold. It is important that the consumer have all the information he or she needs with regard to the moulding being purchased, and it has been the practice to attach labels or signs directly to a rack for such goods identifying the product and providing other pertinent information such as price. It is not uncommon to glue or otherwise affix a section or cut from the moulding to the rack adjacent to the moulding so that the consumer can observe one or more profiles of the moulding, including a cross-sectional profile.

These prior art practices have been less than satisfactory for a number of reasons. Labels and stickers can present an unsightly appearance over time. Furthermore, price and perhaps other pertinent information will change, necessitating either application of a new label or sign or marking up of the old. The cut samples of the moulding glued or otherwise directly secured to the rack are prone to breakage or dislodgement in toto. Many existing storage racks also accommodate a large selection of mouldings with dividers being used to separate the various types. These dividers are often moved so that changes in the mix of mouldings displayed may be accommodated. New mouldings may be added. Certain moulding types may be dropped from the product line altogether, or numbers of the same types of mouldings may vary. When any of these things occur, it is highly possible, or even likely, that the informational material on the signs or stickers attached along the length of the rack will no longer correspond to the moulding types displayed in closest proximity.

DISCLOSURE OF INVENTION

The present invention relates to apparatus which provides for the ready display of informational materials relating to moulding or similar elongated elements stored in a generally upright condition on a rack. The apparatus serves the additional function of preventing the elongated elements from falling from the rack support deck over the front edge thereof.

Apparatus constructed in accordance with the teachings of the present invention allows information concerning the mouldings to be displayed in an attractive manner. Furthermore, the media upon which the informational material is presented can be readily replaced or moved to adapt to changes in the elongated moulding mix or placement of mouldings on the rack.

The elongated element display and retention apparatus of the present invention is for attachment to a storage rack having a support deck with an upper surface partially defined by a front deck edge. The support deck upper surface is engageable by ends of elongated elements to support the elongated elements, such as moulding, in a generally upright condition.

The apparatus includes a housing having interconnected end walls, a bottom wall, a front wall, and a back wall, the interconnected walls defining an interior for accommodating, protecting, and displaying informational materials relating to the elongated elements.

Attachment means is provided for attaching the housing to the storage rack with the housing back wall adjacent to the front deck edge and at least a portion of the housing back wall projecting upwardly to an elevation above the support deck upper surface whereby the back wall is engageable by elongated elements on the support deck to prevent the engaging elongated elements from falling from the support deck over the front deck edge.

The housing back wall has an inclined display surface for supporting the informational materials in positions whereby the information on the informational materials is readily observable from a location above and in front of the housing.

The housing front wall at least partially comprises transparent panel means selectively alternatively attachable to other of the walls of the housing and detachable therefrom.

The informational materials comprise a plurality of discrete informational panels selectively adjustably positionable on the inclined display surface at preselected alternate positions thereon whereby the informational panels may be placed in selective registry with corresponding predetermined types of elongated elements in the storage rack supported by the support deck upper surface.

Other features, advantages, and objects of the present invention will become apparent with reference to the following description and accompanying drawings.

MODES FOR CARRYING OUT THE INVENTION

Figure 1:
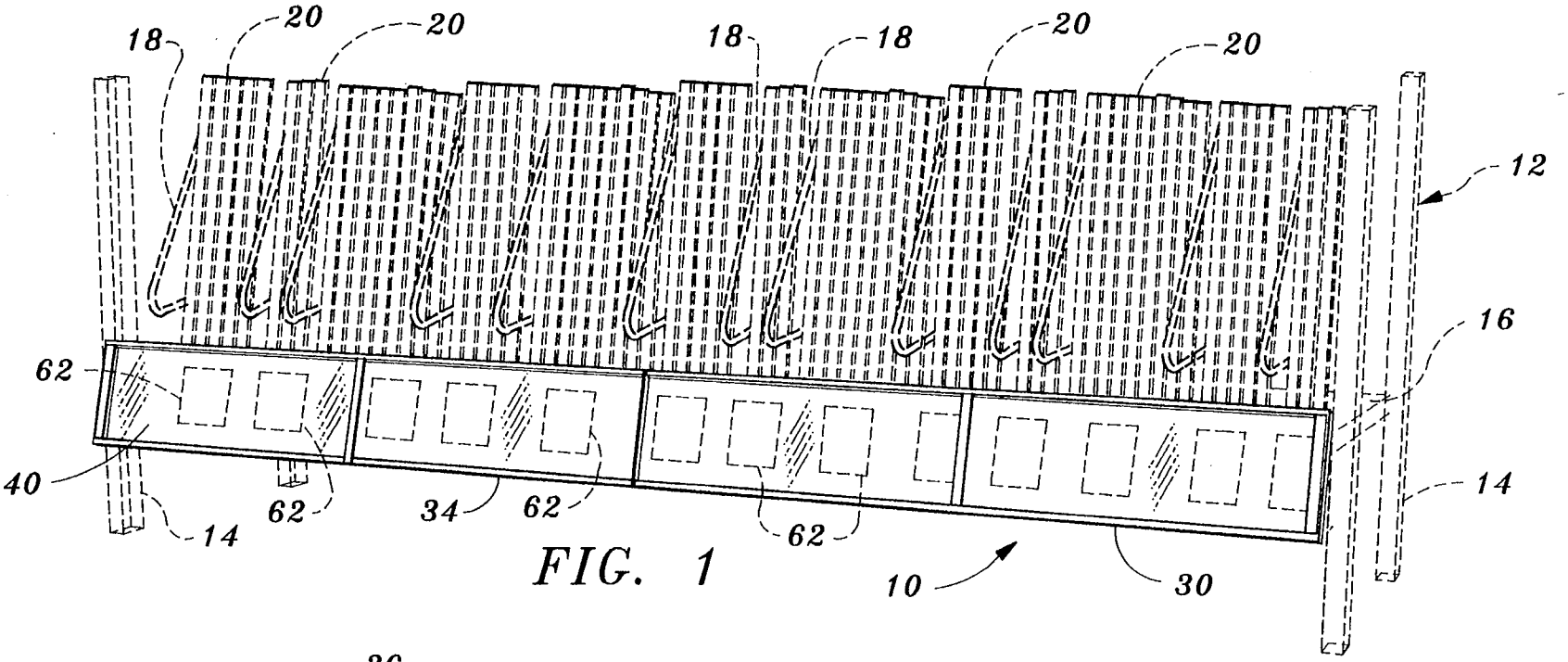
FIG. 1 is a frontal, perspective view of apparatus constructed in accordance with the teachings of the present invention in position on a rack holding mouldings, the rack and mouldings being depicted in dash lines.
Figure 2:
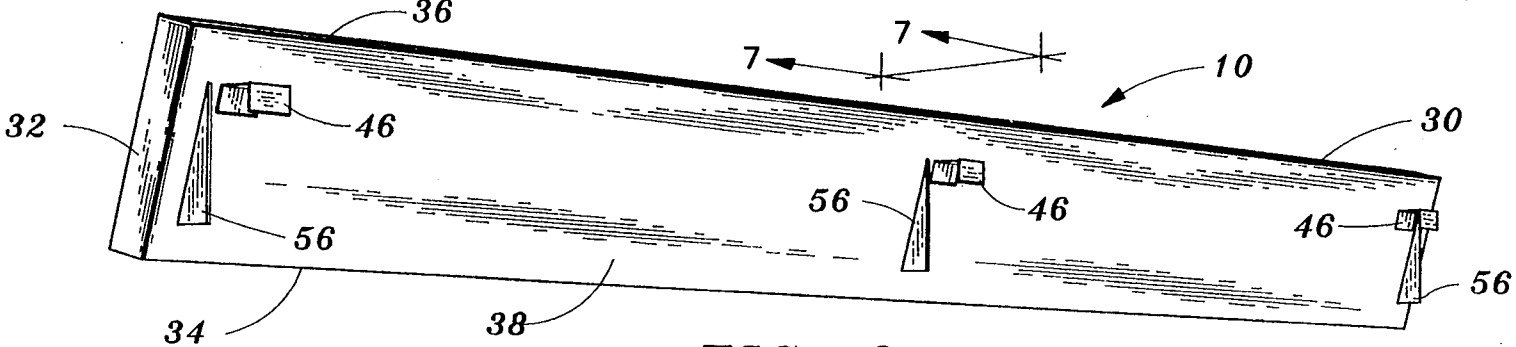
FIG. 2 is a rear, perspective view of the apparatus shown in FIG. 1.
Figure 3:
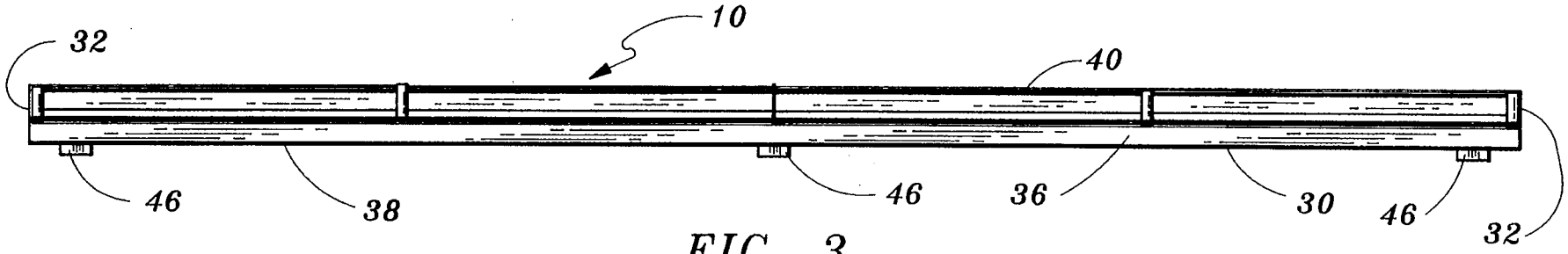
FIG. 3 is a top view of the apparatus.
Figure 4:
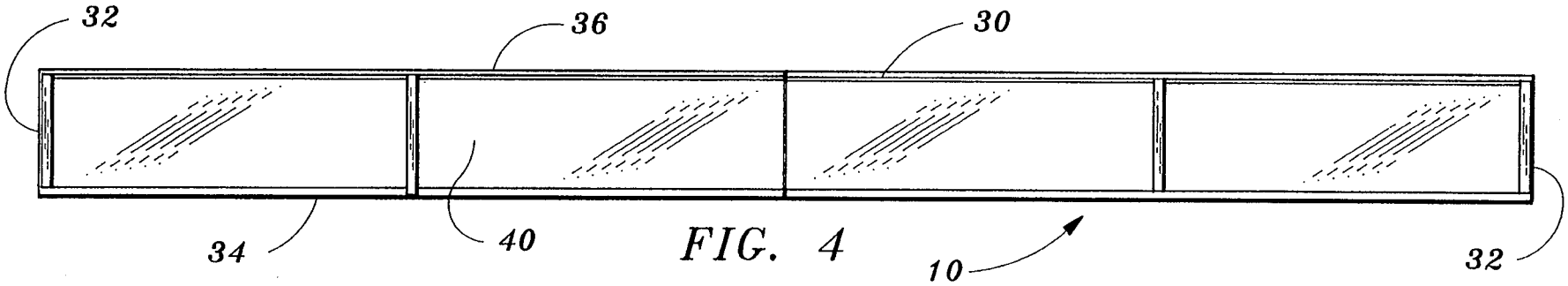
FIG. 4 is a front view of the apparatus.
Figure 5:
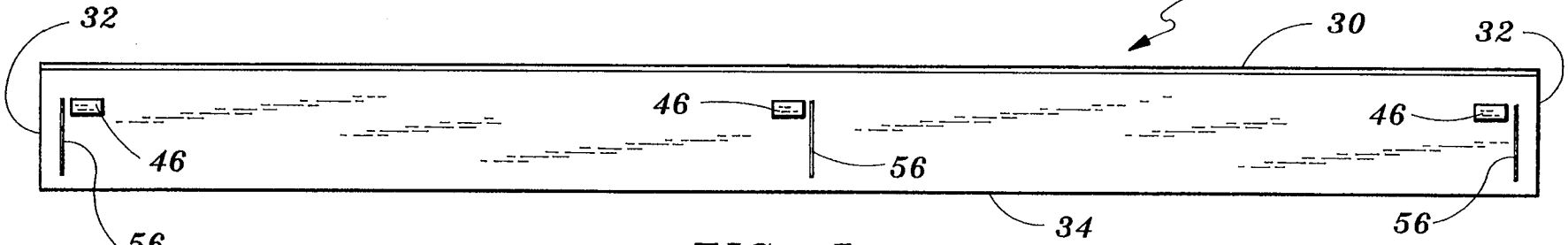
FIG. 5 is a back or rear view of the apparatus.
Figure 6:
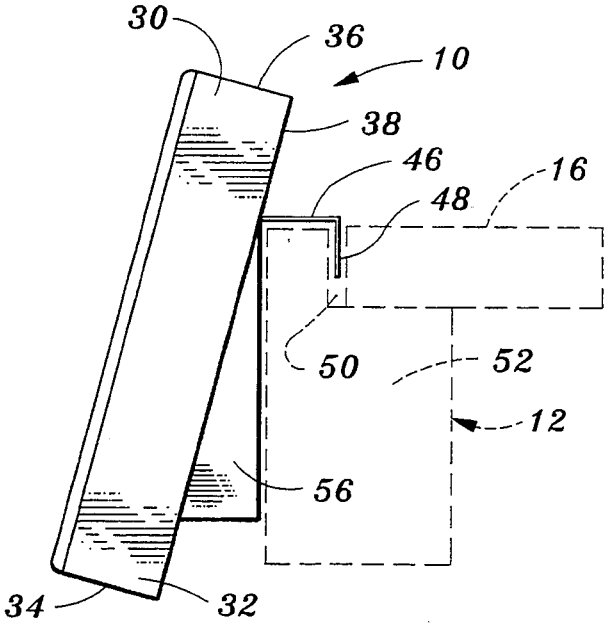
FIG. 6 is a side view of the apparatus, illustrating same in position on a rack, a portion of which is shown in dash lines.

Referring now to FIGS. 1 through 7, moulding display and retention apparatus constructed in accordance with the teachings of the present invention is designated generally by reference numeral 10. In FIGS. 1 and 6, apparatus 10 is shown attached to a storage rack 12. Rack 12 includes uprights 14, a support deck 16, and dividers 18. Storage rack 12 is of a well-known type and will not be described in detail. The rack is for the purpose of displaying and supporting mouldings 20.

The mouldings are generally upright, standing on end upon the support deck 16. The dividers 18 may be moved to different positions along the rack and relative to one another to define discrete areas on the rack utilized to accommodate different types of mouldings. Over time, a store usually changes its mix and numbers of mouldings to a considerable degree so it is quite common for the dividers to be moved rather frequently to accommodate these changes.

As indicated above, changes in molding mix or numbers on a display rack can cause difficulties insofar as labeling is concerned. The apparatus of the present invention readily accommodates itself to these changes, providing for the display of pertinent material relating to the various molding types regardless of where they are positioned along the rack. Furthermore, changes can be made with great convenience and in a manner which will not impair the esthetics of the display.

Apparatus 10 includes a housing 30 including end walls 32, a bottom wall 34, a top wall 36 and a back wall 38. In a preferred embodiment of the present invention, the walls 32, 34, 36, and 38 are formed of sheet steel and welded or otherwise secured together to form a unitary structure. The housing also includes a front wall 40 in the form of a transparent panel of sheet plastic or the like. The panel may be of one-piece construction or comprised of individual panel units.

Figure 7:
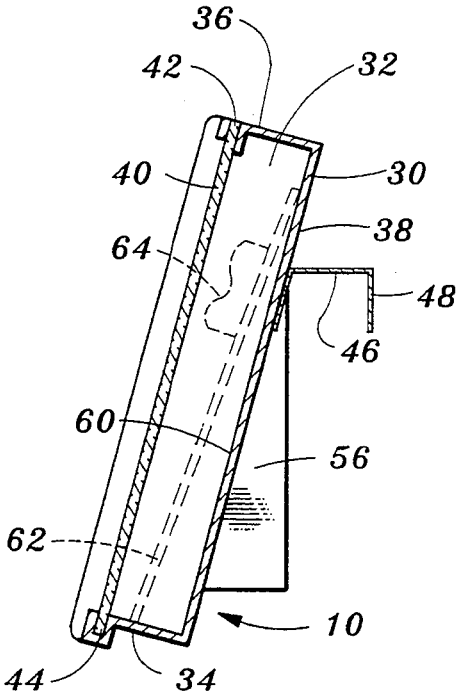
FIG. 7 is a cross-sectional view taken along the line 7—7 in FIG. 2.

As can perhaps best be seen with reference to FIG. 7, the front wall or panel 40 is positioned in a slot 42 formed in top wall 36 of the housing. The bottom end of the front wall is positioned in a recess 44 defined by the bottom wall 34. Front wall 40, in effect, acts as a transparent cover which allows an outside observer to view the interior of the housing. The front wall 40 may be slid in or out of position at will so that manual access may be had to the housing interior when desired. Removal is accomplished simply by exerting upward force on the front wall and removing it from the slot 42.

Means is provided for attaching the housing to the storage rack 12. More particularly, a plurality of rear brackets 46 are welded or otherwise affixed to the back wall 38 of the housing. Each of the brackets 46 has a distal end or downwardly projecting tab 48 which is positionable in a recess 50 formed between a rack cross-piece 52 extending between uprights 14 and support deck 16.

Wedge-shaped spacer elements 56 are also secured to and project from back or rear wall 38. When the housing is mounted on the storage rack 12, spacer elements 56 bear against either the uprights 14 or the cross-piece 52 extending therebetween depending upon the positioning of the spacer elements relative to the rack. Spacer elements 56 maintain the housing 30 in an inclined relationship relative to the storage rack. That is, the back wall 38 of the housing 30 will have an inclined display surface 60 which will ensure that informational materials held by the housing will be readily observable from a location above and in front of the housing through transparent front wall 40.

Information concerning the molding is displayed on discrete informational panels 62 which are selectively adjustably positionable on the inclined display surface at preselected alternate positions thereon. Thus, the informational panels 62 may be placed in selective registry with corresponding predetermined types of moldings in the storage racks supported by the support deck upper surface. In the arrangement shown, the information panels rest on bottom wall 34 and are merely propped against the back wall; however, it will be appreciated that the panels may be flush against the back wall and even secured thereto in a temporary fashion by suitable material such as double-backed adhesive tape. In any event, the informational panels are disposed in a position whereby they can be readily observed by a respective purchaser. In FIG. 7 a cross-sectional segment 64 of molding is affixed to the informational panel. If desired, the interior of the housing may be illuminated by electric lighting (not shown).

When the housing is attached to the storage rack 12, the back wall 38 projects upwardly to an elevation above the support deck upper surface. Thus, the back wall is engageable by molding on the support deck to prevent the molding from falling from the support deck over the front deck edge. Therefore, the housing serves not only as a display vehicle but also as a means for retaining the moldings in position on the rack unless the moldings are manually lifted and removed therefrom.

Figure 8:
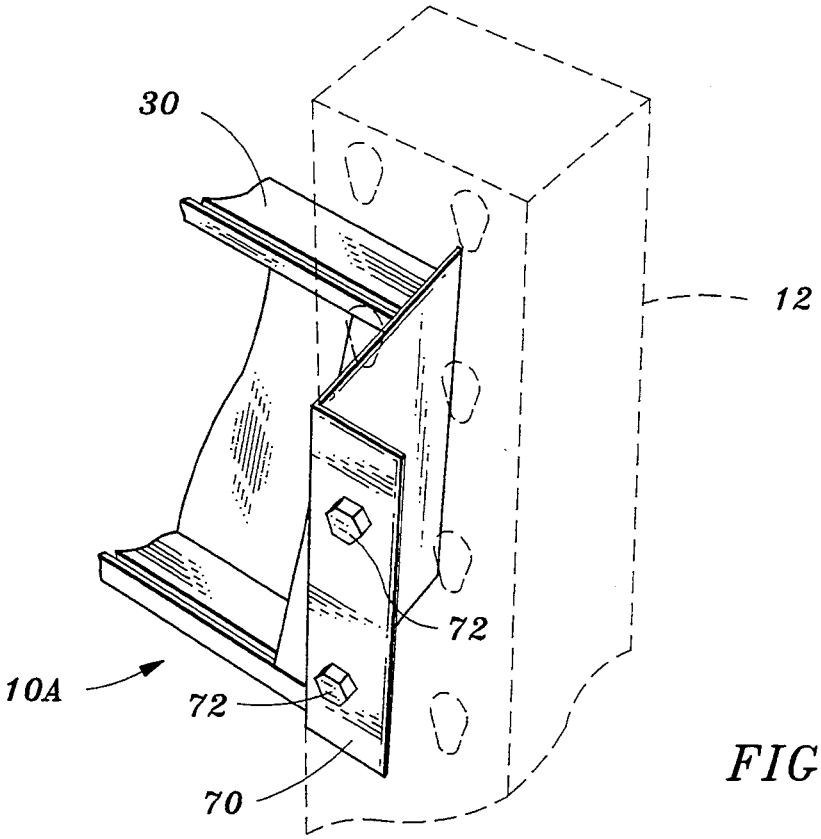
FIG. 8 is a perspective view illustrating an end of an alternative embodiment of the apparatus in place on a rack, a portion of the latter being depicted by dash lines.

FIG. 8 illustrates an end of an alternative form of apparatus, namely, apparatus 10A. Apparatus 10A differs from that of FIGS. 1 through 7 in that it utilizes a different form of attachment means for attaching housing 30 to storage rack 12. More particularly, attachment is had by means of end brackets 70 (only one of which shown in FIG. 8) which engage an upright of the rack and are secured in place thereon by threaded fasteners, such as bolts 72.

I claim:

1. Elongated element display and retention apparatus, said display and retention apparatus for attachment to a storage rack having a support deck with an upper surface partially defined by a front deck edge, said support deck upper surface engageable by ends of elongated elements to support said elongated elements in a generally upright condition, said display and retention apparatus comprising, in combination:

a housing including interconnected end walls, a bottom wall, a top wall, a front wall, and a back wall, said interconnected walls defining an interior for accommodating, protecting, and displaying informational materials relating to said elongated elements;

attachment means for attaching said housing to said storage rack with said housing back wall adjacent to said front deck edge and at least a portion of said housing back wall projecting upwardly to an elevation above said support deck upper surface whereby said back wall is engageable by elongated elements on said support deck to prevent said engaging elongated elements from falling from said support deck over said front deck edge, said housing back wall having an inclined display surface for supporting said informational materials in positions whereby the information on the informational materials is readily observable from a location above and in front of said housing; and spacer means projecting from said housing rear wall away from said housing for engaging said storage rack and cooperating with said storage rack to maintain said display surface inclined.

2. The elongated element display and retention apparatus according to claim 1 wherein said housing front wall at least partially comprises transparent panel means selectively alternatively attachable to other of the walls of said housing and detachable therefrom.

3. The elongated element display and retention apparatus according to claim 1 wherein said informational materials comprise a plurality of discrete informational panels selectively adjustably positionable on said inclined display surface at preselected alternate positions thereon whereby said informational panels may be placed in selective registry with corresponding predetermined types of elongated elements in said storage rack supported by said support deck upper surface.

4. The elongated element display and retention apparatus according to claim 1 wherein said spacer means comprises a plurality of wedge-shaped spacer elements projecting from said rear wall at spaced locations thereon and engageable with said storage rack.

5. The elongated element display and retention apparatus according to claim 3 wherein said elongated elements are moldings, said informational materials including segments of said moldings affixed to said informational panels.

6. The elongated element display and retention apparatus according to claim 5 wherein at least some of said molding segments are cross-sections of said moldings.

7. Elongated element display and retention apparatus, said display and retention apparatus for attachment to a storage rack having a support deck with an upper surface partially defined by a front deck edge, said support deck upper surface engageable by ends of elongated elements to support said elongated elements in a generally upright condition, said display and retention apparatus comprising, in combination:

a housing including interconnected end walls, a bottom wall, a top wall, a front wall, and a back wall, said interconnected walls defining an interior for accommodating, protecting, and displaying informational materials relating to said elongated elements; and attachment means for attaching said housing to said storage rack with said housing back wall adjacent to said front deck edge and at least a portion of said housing back wall projecting upwardly to an elevation above said support deck upper surface whereby said back wall is engageable by elongated elements on said support deck to prevent said engaging elongated elements from falling from said support deck over said front deck edge, said attachment means comprising a plurality of rear brackets affixed to said housing and projecting rearwardly thereof away from said back wall, said brackets each including a distal end positionable in a recess defined by said storage rack to attach said housing to said storage rack.

8. Elongated element display and retention apparatus, said display and retention apparatus for attachment to a storage rack having a support deck with an upper surface partially defined by a front deck edge, said support deck upper surface engageable by ends of elongated elements to support said elongated elements in a generally upright condition, said display and retention apparatus comprising, in combination:

a housing including interconnected end walls, a bottom wall, a top wall, a front wall, and a back wall, said interconnected walls defining an interior for accommodating, protecting, and displaying informational materials relating to said elongated elements; and attachment means for attaching said housing to said storage rack with said housing back wall adjacent to said front deck edge and at least a portion of said housing back wall projecting upwardly to an elevation above said support deck upper surface whereby said back wall is engageable by elongated elements on said support deck to prevent said engaging elongated elements from falling from said support deck over said front deck edge, said attachment means comprising end brackets attached to said housing at said end walls and mechanical fastener means for fastening said end brackets to said storage rack.

9. Elongated element display and retention apparatus, said display and retention apparatus for attachment to a storage rack having a support deck with an upper surface partially defined by a front deck edge, said support deck upper surface engageable by ends of elongated elements to support said elongated elements in a generally upright condition, said display and retention apparatus comprising, in combination:

a housing including interconnected end walls, a bottom wall, a top wall, a front wall, and a back wall, said interconnected walls defining an interior for accommodating, protecting, and displaying informational materials relating to said elongated elements;

attachment means for attaching said housing to said storage rack with said housing back wall adjacent to said front deck edge and at least a portion of said housing back wall projecting upwardly to an elevation above said support deck upper surface whereby said back wall is engageable by elongated elements on said support deck to prevent said engaging elongated elements from falling from said support deck over said front deck edge; and reinforcement elements affixed to said housing at spaced locations along the length thereof in partial registry with said inclined display surface and spaced therefrom.

* * * * *